US006776661B2

(12) United States Patent
Dingenotto et al.

(10) Patent No.: US 6,776,661 B2
(45) Date of Patent: Aug. 17, 2004

(54) PLANAR FILTER AND MULTI-POLE ANGLE-CONNECTING DEVICE WITH A PLANAR FILTER

(75) Inventors: Meinolf Dingenotto, Schloss Holte-Stukenbrock (DE); Frank Wallmeier, Lippstadt (DE)

(73) Assignee: Filtec Filtertechnologie fuer die Elektronikindustrie GmbH, Lippstadt (DE)

( * ) Notice: Subject to any disclaimer, the term of this patent is extended or adjusted under 35 U.S.C. 154(b) by 0 days.

(21) Appl. No.: 10/035,873

(22) Filed: Dec. 31, 2001

(65) Prior Publication Data

US 2002/0151220 A1 Oct. 17, 2002

Related U.S. Application Data

(63) Continuation-in-part of application No. 09/479,022, filed on Jan. 7, 2000, now abandoned.

(30) Foreign Application Priority Data

Feb. 12, 1999 (DE) ..... 299 02 505 U

(51) Int. Cl.[7] ..... H01R 33/945; H01R 13/68

(52) U.S. Cl. ..... 439/620

(58) Field of Search ..... 439/620, 95, 108, 439/326, 941; 333/191, 192, 182

(56) References Cited

U.S. PATENT DOCUMENTS 5,219,305 A * 6/1993 Kawaguchi et al. ..... 439/620
5,242,318 A * 9/1993 Plass ..... 439/620
5,257,950 A * 11/1993 Lenker et al. ..... 439/620
5,280,257 A * 1/1994 Cravens et al. ..... 333/182

* cited by examiner

*Primary Examiner*—Chandrika Prasad
(74) *Attorney, Agent, or Firm*—Laurence A. Greenberg; Werner H. Stemer; Ralph E. Locher

(57) ABSTRACT

A planar filter has a monolithic construction in order to suppress parasitic capacitances between signal electrodes and many signal pins which are led through a carrier and which each have a capacitor with a signal layer connected to the signal pin, a ground layer connected to ground and a dielectric layer separating the two layers. The electrodes of the capacitors are applied to the carrier, which forms the dielectric, is shaped as a block from a mass of a higher dielectric constant and, after shaping and perforation, is sintered and ground. The ground electrode covers the entire surface area of one of the side surfaces of the carrier, apart from pin lead-throughs of the signal pins and their surrounding area. The signal electrodes on the other side surface of the carrier form insular regions extending from the pin lead-throughs of the signal pins to the edge of the carrier. This planar filter, advantageously provided with a supporting plate, is used, for example, in plug-in connectors soldered onto printed circuit boards. A multi-pole angle-connecting device with a planar filter is also provided.

15 Claims, 3 Drawing Sheets

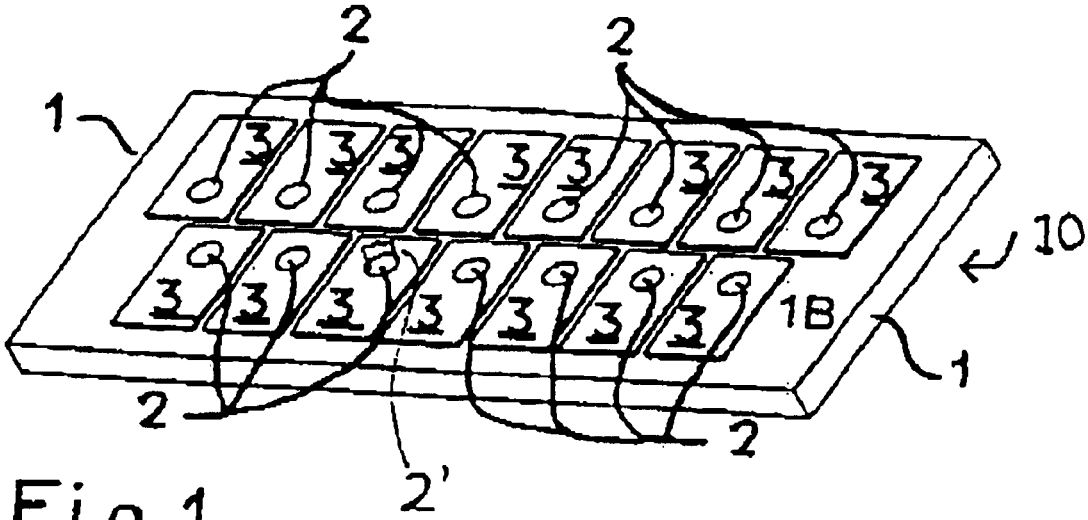
Fig.1
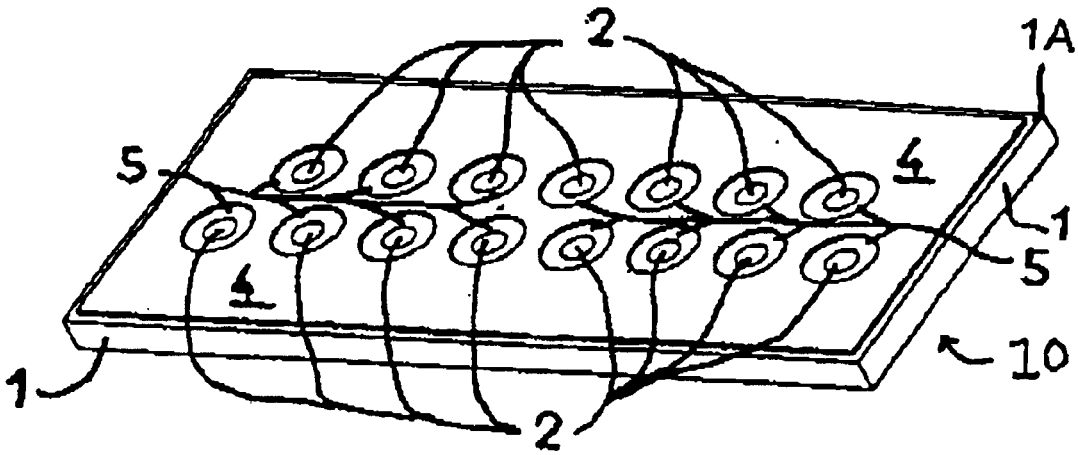
Fig.2
Fig.3
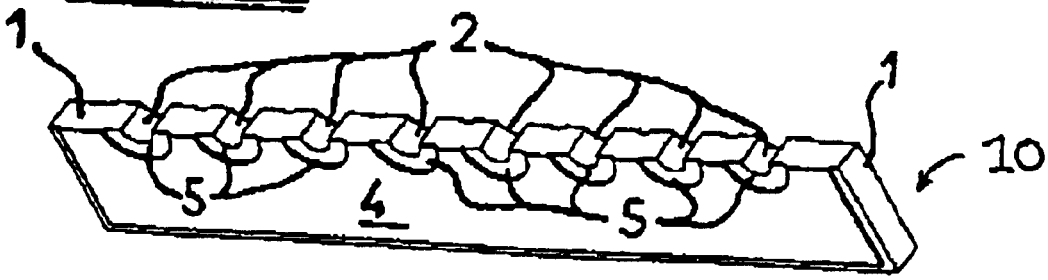

PLANAR FILTER AND MULTI-POLE ANGLE-CONNECTING DEVICE WITH A PLANAR FILTER

CROSS-REFERENCE TO RELATED APPLICATIONS

This application is a Continuation-In-Part of U.S. application Ser. No. 09/479,022, filed Jan. 7, 2000. Now abandoned.

BACKGROUND OF THE INVENTION

FIELD OF THE INVENTION

The invention relates to a planar filter for plug-in connectors having a multiplicity of signal pins to be connected that are disposed in rows and columns, a carrier which has an opening for each of the signal pins, and a capacitor in the vicinity of each of the openings with a first layer connected to an assigned signal conductor, a second layer for connection to ground and a dielectric in the form of a layer between the first layer and the second layer. The invention also relates to a multi-pole angle-connecting device with a planar filter.

In the case of multi-pole plug-in connectors, which are used for the transmission of digital or analog measuring signals from multi-function measuring devices or in high-speed transmission of information, there is the necessity for filtering in order to filter out interference signals that are introduced. That filtering-out of interference signals which are introduced generally takes place with capacitors, of which there is one provided for each line carrying a signal. For that purpose, the capacitors are advantageously combined into planar filters and inserted into the plug-in connectors. The planar filters are passed through by the signal conductors and there is at least one capacitor provided for each of the signal conductors. The capacitors are disposed on a carrier, that is generally formed of alumina. French Patent 2 422 268 describes such a plug-in connector with filtering for each connector pin. The connectors are inserted in a ceramic sheet provided with holes and are carried by that sheet. Each capacitor configuration includes a small dielectric ceramic sheet, which for its part is provided on one side with grounding electrodes that are provided throughout the surface with the exception of regions of the pin lead-throughs, and on the other side with insular signal electrodes which are electrically connected to the connector pins. The coating of the electrodes takes place, as is known from U.S. Pat. No. 4,007,296, by the screen-printing process, with the customary pastes based on noble metals (including palladium among others). The grounding electrodes change into lateral metallizations, which are connected to the metallic housing and represent a ground discharge for the capacitors of the signal electrodes to the connector housing, and then on to the connected device. Another filter is formed by either a ground electrode with clearances for the connector pins or a number of signal electrodes corresponding to the number of connector pins being applied to the carrier. A dielectric layer is applied on top thereof and finally the other electrode layer, that is to say the number of signal electrodes corresponding to the number of connector pins or a ground electrode with clearances for the connector pins, is applied on top thereof (see European Patent 0 124 264, U.S. Pat. No. 3,267,342 and U.S. Pat. No. 3,544,434). That configuration is then protected from external influences by a coating of a resistant material, for instance a lacquer. However, in that case too the carrier is formed by an alumina material, to which the electrodes are applied, generally through the use of a screen-printing technique, with a dielectric layer lying between. In the case of those filters, the conductive layers and the dielectric layers are applied in the manner of a "sandwich" through the use of a screen-printing technique, which causes problems in terms of the dielectric strength due to the thin dielectric layers. Since neighboring signal electrodes are disposed at only a small distance from one another, a capacitive coupling through unavoidable cross-capacitances cannot be ruled out. That coupling is extremely minor. However, in the case of the known planar capacitors, the mutually facing end surfaces of the signal electrodes are extremely small because of their small layer thickness and the layer thicknesses of the dielectric layers are similarly extremely small, so that the resultant cross-capacitance is extremely small and the problem of crosstalk becomes insignificant. The production of such planar filters also requires an alternating application of metallic layers and dielectric layers and is therefore (relatively) complex. Furthermore, such planar filters lack dielectric strength. In order to improve the dielectric strengths, thicker dielectric layers are necessary. Then, however, the cross-capacitances that are decisive for a coupling assume values which no longer rule out crosstalk. Such a configuration, with capacitors of high dielectric strength formed as classic sheet capacitors, in which the parasitic capacitances can form and in certain cases can disturb signal transmission, is described in German Utility Model 297 12 001.8.

SUMMARY OF THE INVENTION

It is accordingly an object of the invention to provide a planar filter and a multi-pole angle-connecting device with a planar filter, which overcome the hereinafore-mentioned disadvantages of the heretofore-known devices of this general type, in which parasitic capacitances between signal electrodes are suppressed while maintaining dielectric strength, which can be produced cost-effectively and easily and which can be used reliably.

With the foregoing and other objects in view there is provided, in accordance with the invention, in a plug-in connector having signal conductors, a multiplicity of signal pins to be connected, the signal pins disposed in rows and columns, and a carrier having openings formed therein each for receiving a respective one of the signal pins, a monolithic planar filter, comprising capacitors each disposed in the vicinity of a respective one of the openings, the capacitors each having a first layer connected to an assigned one of the signal conductors, a second layer for connection to ground, and a dielectric carrier in the form of a layer disposed between the first and second layers, the carrier having two side surfaces, an edge and pin lead-throughs for the signal pins, and the carrier formed of a mass with a relatively high dielectric constant shaped into a block, perforated and subsequently sintered and ground; the ground electrode applied to and entirely areally covering one of the side surfaces of the carrier apart from the pin lead-throughs and a directly surrounding area, and the signal electrodes applied to the other of the side surfaces of the carrier, extending from the pin lead-throughs and forming insular regions extending substantially from the signal pins to the edge of the carrier.

According to the invention, the planar filter has a monolithic structure and the carrier is a mechanically inflexible and rigid layer of a ceramic mass with a relatively high dielectric constant.

In accordance with another feature of the invention, ceramic masses which are suitable are those with a dielectric constant of not less than 5,000. Such masses are, for example, barium titanate masses. The dielectric constant is advantageously greater than 10,000.

The plate which is formed from this mass is provided with the holes necessary for leading through the signal pins, fired and sintered. After the thermal treatment, the plate which is thus obtained is ground to achieve planarity. The thickness of the carrier in this case ensures its dielectric strength. The capacitors for each of the pin lead-throughs are formed by signal electrodes assigned to them and a ground electrode.

One side of this sheet of the ceramic carrier that is prepared in this way bears the ground electrode and the other side is provided with the signal electrodes of the capacitors, which is applied with conductive printing pastes by screen printing. In this case, the ground electrode can be led at least up to one of the outer narrow sides of the carrier, for establishing a connection to the ground-housing of the plug-in connector.

Each signal electrode which surrounds a lead-through opening for the assigned connector pin may have been led into the lead-through, which provides an improved possibility for soldering with the connector pin concerned. Since the ground electrode covers the entire surface area of one of the side surfaces of the carrier, apart from the locations where the signal pins penetrate and their directly surrounding area, good shielding is achieved. The signal electrodes disposed on the other side surface of the carrier form insular regions, which extend from the locations where the signal pins penetrate, essentially surround the signal-pin lead-through and extend laterally to the edge of the carrier.

In accordance with a further feature of the invention, in order to obtain as smooth a surface as possible and consequently precisely defined electrical conditions, both side surfaces are lapped to planarity before applying the layers of the capacitors. This surface, which is thus particularly smooth and level, ensures a field-strength distribution undisturbed by deviating geometrical conditions.

Since the individual signal electrodes are opposite one another merely at their end surfaces, which account for negligible proportions of the surface area, the parasitic capacitances causing a capacitive coupling between the signal conductors are also negligible. As a result, a capacitive coupling due to cross-capacitances or parasitic capacitances is at least reduced, if not ruled out entirely, so that crosstalk phenomena during analog transmissions are suppressed.

In accordance with an added feature of the invention, a ceramic on a titanate basis is advantageously provided as the mass for this dielectric. Titantates of alkaline earth metals, for instance barium, strontium or a mixture thereof, are used in particular therefor. These masses, sintered as ceramic, have adequate mechanical strength and have higher dielectric constants, so that the desired capacitances can be achieved even with greater thicknesses of the carrier.

With the objects of the invention in view there is also provided a multi-pole angle-connecting device, comprising the signal conductors each being continuous, assigned to a respective pole and disposed in a configuration; the lead-through openings in the carrier of the planar filter disposed in a configuration; a supporting plate, particularly in the form of a printed circuit board, having soldering points and lead-through openings in a configuration corresponding to one of the configuration of the lead-through openings and the configuration of the signal conductors; and the planar filter according to claim 1 having a side to be soldered onto and areally supported by the supporting plate; the signal conductors each having one end to be soldered to a corresponding one of the soldering points and another end constructed as one of a connector pin and a plug-in socket.

Therefore, in one application, this planar filter is supported by a supporting plate, which is disposed so as to lie areally against one of the two sides of the planar filter. Application on the side on which mechanical stresses are to be expected is advantageous. The supporting plate, which is an insulating printed circuit board or a preferably ceramic substrate sheet, has the same pattern of holes for the signal conductors which are to be led through as the planar filter. These lead-throughs are metallized, at least in the region of one end surface, so that the signal conductors can be securely soldered to the supporting plate. In this case, the metallization leads into the lead-through, so that the contact points of the signal electrodes of the planar filter are included in soldering by solder drawn through by capillary action, so that the planar filter is included and brought into electrical contact by one soldering operation.

Other features which are considered as characteristic for the invention are set forth in the appended claims.

Although the invention is illustrated and described herein as embodied in a planar filter and a multi-pole angle-connecting device with a planar filter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a diagrammatic, perspective view of a signal-electrode side of a planar filter;

FIG. 2 is a perspective view of a ground-electrode side of a planar filter;

FIG. 3 is a fragmentary, perspective, sectional view of a planar filter, taken through a row of pin lead-throughs;

DESCRIPTION OF THE PREFERRED EMBODIMENTS

Figure 4:
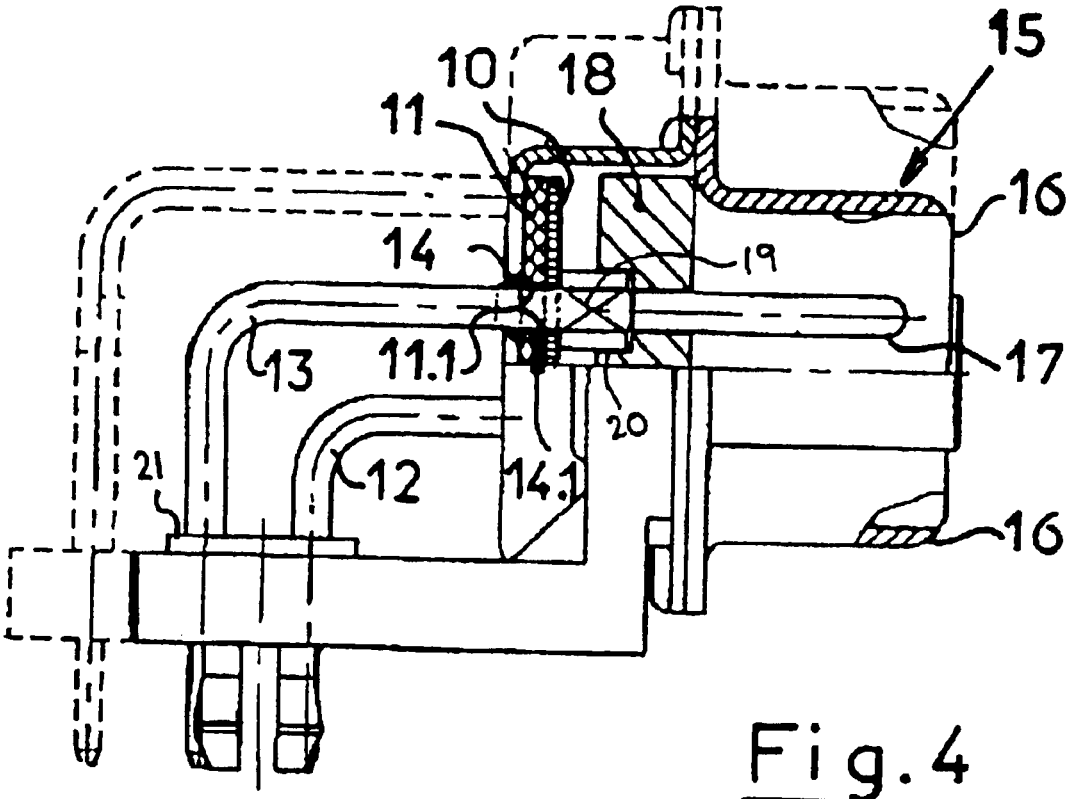
FIG. 4 is a partly broken-away and partly sectional view of an angle-connecting device with a supported planar filter.

Referring now to the figures of the drawings in detail and first, particularly, to FIGS. 1–3 thereof, there is seen a carrier 1 of a planar filter generally marked by the reference number 10 which is formed by a block of an alkaline earth metal titanate, for instance barium titanate, strontium titanate or barium-strontium titanate, in which an excess of barium promises better results. This block, which is shown as being rectangular herein, with pin lead-throughs 2 for pins 2', has been shaped and sintered and at least finish-ground, in order to achieve a level surface. Signal electrodes or first layers 3, which are applied to one side surface 1B of this carrier or dielectric layer 1, are led up to and preferably even into, openings of the respectively assigned pin lead-throughs 2. Another side surface 1A of the carrier or dielectric layer 1 is covered throughout with a ground electrode or second layer 4, in such a way that the pin lead-throughs 2 and a directly surrounding area having been left exposed. This ground electrode 4 is connected through the use of a silver or palladium conductive adhesive when the planar filter is inserted into a non-illustrated housing with a metallic mating piece. In this way an electrical ground connection is established.

The surface area of the signal electrodes 3, which are shown herein as being rectangular, together with the thickness of the carrier 1 and the dielectric constant of its material, determine the capacitance of the filter capacitors. Changing the surface areas of the individual signal electrodes 3 allows different capacitances to be established for the individual signal conductors connected to the pins 2'. The overall capacitance of a plug-in connector provided with such planar filters can consequently be achieved or set by the number of individual planar filters constructed in this way and by varying the size of the surface area of the signal electrodes.

The ground electrode 4, which is shown as being provided throughout, covers (virtually) the entire surface area of the carrier 1, apart from lead-through clearances 5. The lead-through clearances 5 ensure that short-circuits or flashovers between the pins 2' led through the pin lead-throughs 2 of the led-through signal conductors and the ground electrode 4 are prevented. This ground electrode 4 is shown herein as not being directly at the edge of the side surface of the carrier 1. It goes without saying herein that this metallic layer may also be taken up to at least one of the edge surfaces, for establishing the ground connection to the housing of a plug-in connector.

FIG. 4 shows an advantageous application of a supported filter 10 in a plug-in connector 15 with a plug housing 16 and plug pins 17 which are held through the use of an insulating pin holder 18. A supporting plate 11, such as a printed circuit board, a substrate or the like, is provided with lead-through openings 11.1 for a number of signal conductors 12 and 13 (as well as an undesignated signal conductor indicated by dashed lines in the case of 3-row plug-in connectors). The lead-through openings 11.1 are provided in such a way that a pattern of these openings 11.1 coincides with a pattern of openings in the carrier of the planar filter 10. The supporting plate 11 can be placed against the planar filter 10 to bear with surface-area contact. The openings 11.1 are metallized at least at edges and preferably in the lumen as well. The planar filter 10 can thus be inserted together with the supporting plate 11 (for example into a plug-in connector 15). The signal conductors 12 and 13 passing through the supporting plate 11 and the planar filter 10 are soldered to the metallizations in the region of the openings 11.1 in the supporting plate 11. Soldering joints 14 fix the signal conductors 12 and 13 on the supporting plate 11. In order to solder with the signal electrodes 3 (FIG. 2) of the planar filter 10 as well, it is adequate if the openings 11.1 are formed in the supporting plate 11 in such a way that the solder 14.1 is drawn by capillary action into a gap between an inner wall surface of the openings 11.1 and an outer surface of the respective signal conductors 12 and 13. The solder is thus led through the individual openings 11.1, provided with the assigned conductor of the signal conductors 12 and 13, up to the assigned, exposed signal electrode 3. Electrical connection of the signal conductors 12 and 13 to the assigned electrode of the signal electrodes 3 is thus ensured. This structure has the advantage of ensuring that the signal conductors 12 can be initially installed in their extended form. Subsequent bending in desired directions no longer mechanically stresses the planar filter 10.

Figure 5:
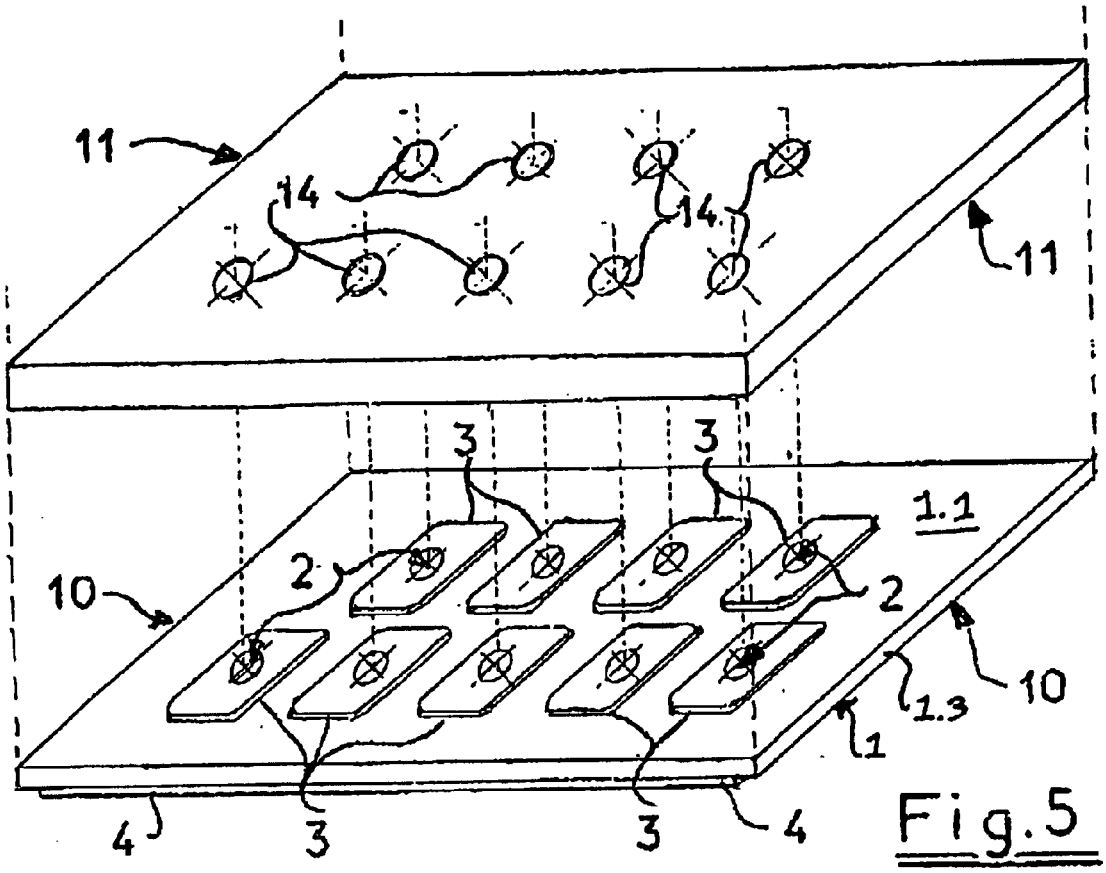
FIG. 5 is an exploded view of the planar filter.
Figure 6:
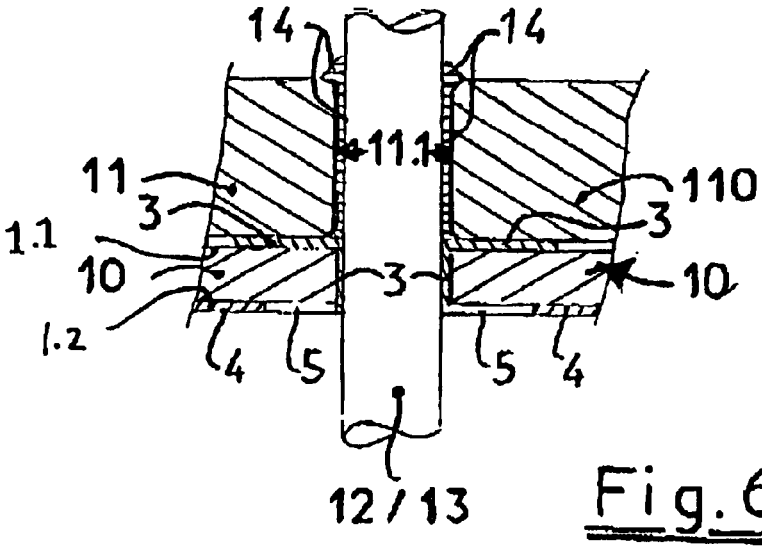
FIG. 6 is a partial sectional view of the planar filter.

An embodiment of the configuration as shown in FIG. 4 is illustrated in detail in FIGS. 5 and 6. This configuration is a combination of a planar filter 10 and a support plate 11. FIGS. 5 and 6 show exploded views of the planar filter 10 and the support plate 11 to illustrate their components more clearly.

The embodiments of the planar filter 10 and the support plate 11 shown in FIGS. 5 and 6 are intended for use with the 9-pin plug-in connector. However, an embodiment for a 15-pin connector could be constructed and would have features similar to those shown in FIGS. 1–3 wherein the signal electrodes 3 and ground electrode 4 have increased height.

While FIG. 5 is an exploded view, the supporting plate 11 actually directly attaches to the planar filter 10 (see FIGS. 4 and 6). The supporting plate 11 is provided with pin lead-throughs 11.1 that are configured to overlay the pin lead-throughs 2 of the planar filter 10, respectively. The pin lead-throughs 11.1 are aligned with the pin lead-throughs 2 of the planar filter 10. The pin lead-throughs 11.1 are metallized (edges as well as inner walls) and are configured such that a gap is formed between the inner walls of each of the pin lead-throughs 11.1 and their respective pins 13 being led through the corresponding lead-through 11.1. The edges of the pin lead-throughs 11.1 are preferably provided with chambers. When being built, the supporting plate 11 and the planar filter 10 are placed together so that the supporting plate 11 is lying directly against the side wall of the planar filter 10 bearing the signal electrodes 3 so that the signal pins 13 are lead through the pin lead-throughs 11.1. In this position, the configuration is soldered so that the solder 14 joins each of the pins 13 to the corresponding metallized pin lead-through 11.1 and that the solder 14 is drawn by capillary forces into the gap to the signal electrodes 2 so that an electrical connection to the signal electrodes 2 arises. This configuration forms a compact block that can be handled in an easy manner.

We claim:

1. A filter configuration for a multi-pole plug-in connector to be mounted in a shell and having a plurality of signal pins to be connected, comprising:

a monolithic planar filter having a plurality of capacitors, said capacitors having:

a plurality of signal electrodes for connecting to the signal pins, one common shared ground electrode, and one common shared dielectric layer formed of a ceramic material disposed between said ground electrode and said plurality of signal electrodes, having two side surfaces and an edge, and being block shaped, perforated with pin lead-throughs for receiving the signal pins, and subsequently sintered, a first of said side surfaces bearing said ground electrode, said side surface bearing said ground electrode being lapped to planarity to prevent overloads caused by spot-loads, and a second of said side surfaces bearing said signal electrodes; and a supporting plate being sintered and formed as a printed-circuit-board dielectric plate with a dielectric constant lower than said dielectric layer and having supporting-plate pin lead-throughs corresponding to the pin lead-throughs;

said supporting-plate pin lead-throughs having a diameter sufficiently wider than the signal pins to draw solder via capillary action into said pin lead-throughs;

said planar filter and said supporting plate being separately finished.

2. The filter configuration according to claim 1, wherein said base is formed of titanate.

3. The filter configuration according to claim 1, wherein said base is formed of strontium titanate.

4. The filter configuration according to claim 1 for the multi-pole plug-in connector having a multiplicity of the signal pins to be connected, wherein:

said dielectric layer has a multiplicity of said pin lead-throughs formed therein each corresponding to one of the multiplicity of the signal pins;

said support plate has a multiplicity of said pin lead-throughs formed therein, each of the pin lead throughs having a respective pin-lead through, and a multiplicity of said signal electrodes, each of said signal electrodes having a respective pin-lead through.

5. The filter configuration according to claim 4, wherein the multiplicity of the signal pins are disposed in rows and columns.

6. A multi-pole angle-connecting device, comprising:

a plurality of signal pins having one end to be soldered to a soldering joint and another end having a connector;

a monolithic planar filter having a plurality of capacitors, said capacitors having:

a plurality of signal electrodes, each connected to a respective one of said signal pins, one common shared ground electrode, and one common shared dielectric layer formed of a ceramic material disposed between said ground electrode and said plurality of signal electrodes, having two side surfaces and an edge, and being block shaped, perforated with pin lead-throughs for receiving said signal pins, and subsequently sintered, a first of said side surfaces bearing said ground electrode, said side surface bearing said ground electrode being lapped to planarity to prevent overloads caused by spot-loads, and a second of said side surfaces bearing said signal electrodes; and a supporting plate being sintered and formed as a printed-circuit-board dielectric plate with a dielectric constant lower than said dielectric layer and having a pin lead-throughs corresponding to the pin lead-throughs;

said supporting-plate pin lead throughs having a diameter sufficiently wider than the signal pins to draw solder via capillary action into said pin lead-throughs; and solder in said pin lead-throughs fixing said planar filter to said signal pins, fixing said supporting plate to said signal pins fixing said planar filter to said supporting plate, and connecting said insular regions of said signal electrodes to said signal pins.

7. The multi-pole angle-connecting device according to claim 6, wherein said connector is a connector pin.

8. The multi-pole angle-connecting device according to claim 6, wherein said connector is a plug-in socket.

9. The filter configuration according to claim 1, wherein said support plate has two opposing sides, said sides being fine-ground and lapped to be flat and parallel to each other.

10. The multi-pole angle-connecting device according to claim 6, wherein said support plate has two opposing sides, said sides being fine-ground and lapped to be flat and parallel to each other.

11. The filter configuration according to claim 1, wherein:

said supporting plate is to be connected to the signal pins by soldering the openings in said support plate to the signal pins;

said planar filter is to be connected to the signal pins by soldering the signal electrodes to the signal pins; and said supporting plate and said planar filter abut and are not fixed directly to each other.

12. The multi-pole angle-connecting device according to claim 6, wherein:

said supporting plate is to be connected to the signal pins by soldering the openings in said support plate to the signal pins;

said planar filter is to be connected to the signal pins by soldering the signal electrodes to the signal pins; and said supporting plate and said planar filter abut and are not fixed directly to each other.

13. The filter configuration according to claim 1, wherein said ground electrode is applied to said dielectric layer subsequent sintering of said dielectric layer.

14. The multi-pole angle-connecting device according to claim 6, wherein said ground electrode is applied to said dielectric layer subsequent sintering of said dielectric layer.

15. The multi-pole angle-connecting device according to claim 6, wherein said planar filter and said supporting plate are separately finished.

* * * * *